US010496025B2

(12) United States Patent
Kase

(10) Patent No.: US 10,496,025 B2
(45) Date of Patent: Dec. 3, 2019

(54) DRIVING DEVICE AND IMAGE FORMING APPARATUS

(71) Applicant: CANON KABUSHIKI KAISHA, Tokyo (JP)

(72) Inventor: Shota Kase, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 60 days.

(21) Appl. No.: 15/802,942

(22) Filed: Nov. 3, 2017

(65) Prior Publication Data

US 2018/0143579 A1 May 24, 2018

(30) Foreign Application Priority Data

Nov. 22, 2016 (JP) ..... 2016-226695

(51) Int. Cl.
*G03G 15/00* (2006.01)
*G03G 15/16* (2006.01)
*G03G 21/16* (2006.01)

(52) U.S. Cl.
CPC ..... *G03G 15/757* (2013.01); *G03G 15/1615* (2013.01); *G03G 15/758* (2013.01); *G03G 21/1647* (2013.01); *G03G 21/1633* (2013.01); *G03G 2221/1657* (2013.01)

(58) Field of Classification Search
CPC ..... G03G 15/757
USPC ..... 399/167
See application file for complete search history.

(56) References Cited

U.S. PATENT DOCUMENTS 5,631,726 A * 5/1997 Sawada ..... G03G 15/757 399/111
6,036,052 A * 3/2000 Tong ..... G07B 3/02 221/255
6,885,837 B2 * 4/2005 Matsubara ..... G03G 15/757 399/167
9,778,614 B2 * 10/2017 Tamura ..... G03G 21/1647
2008/0303364 A1 * 12/2008 Ogawa ..... H02K 7/116 310/80
2013/0322930 A1 * 12/2013 Chino ..... G03G 21/1647 399/279
2014/0133884 A1 * 5/2014 Toyoda ..... G03G 15/751 399/111
2016/0257137 A1 * 9/2016 Segawa ..... B41J 11/007

FOREIGN PATENT DOCUMENTS

JP S61-167739 A 7/1986
JP 2000-193047 A 7/2000
JP 2003-255638 A 9/2003

* cited by examiner

*Primary Examiner* — Anthony H Nguyen
(74) *Attorney, Agent, or Firm* — Venable LLP

(57) ABSTRACT

A driving device includes a motor including a shaft portion provided with a gear portion; a side plate provided with a first hole through which the motor engages with the side plate and a second hole connecting with the first hole; a gear configured to engage with the gear portion provided on the shaft portion when the motor is fixed in the first hole, so as to be rotatable through transmission of a driving force from the motor; and a flexible cover member configured to cover the second hole, wherein the cover member contacts the shaft portion of the motor when the shaft portion of the motor is inserted into the second hole.

9 Claims, 8 Drawing Sheets

(a) PRIOR ART (b) PRIOR ART

DRIVING DEVICE AND IMAGE FORMING APPARATUS

FIELD OF THE INVENTION AND RELATED ART

The present invention relates to a driving device suitable for an image forming apparatus such as an electrophotographic copying machine, an electrophotographic printer (for example, a laser beam printer, an LED printer or the like) and relates to the image forming apparatus including the driving device.

Japanese Laid-Open Patent Application (JP-A) 2003-255638 proposes a constitution in which when a motor used for drive control of the image forming apparatus is assembled, a risk of damage of a gear rotated by transmitting a driving force thereto from the motor is reduced. Parts (a) and (b) of FIG. 8 are schematic views showing a structure of a driving device disclosed in JP-A 2003-255638, in which part (a) of FIG. 8 shows the structure of the driving device before assembling, and part (b) of FIG. 8 shows the structure of the driving device after the assembling.

As shown in FIG. 8, a driving device 100 includes a motor 102, a side plate 104 to which the motor 102 is fixed, and a gear 103 rotates by transmitting the driving force thereto from the motor 103. The side plate 104 is provided with a motor mounting hole 101, and the motor mounting hole 101 is constituted by a first hole 101*a* in which the motor 102 is engaged and fixed and a second hole 101*b* formed in communication with the first hole 101*a*.

During assembling of the motor 102, first, a shaft 102*a* of the motor 102 is inserted in an arrow L direction while aiming at a center of the second hole 101*b*, and thereafter, the shaft 102*a* is moved in an arrow D direction. As a result, a positioning portion 102*b* of the motor 102 and the first hole 101*a* engage with each other, so that the motor 102 is fixed to the side plate 104, and the motor 102 and the gear 103 engage with each other and thus the driving force can be transmitted.

By employing such an assembling constitution, compared with a constitution in which the shaft 102*a* is directly inserted in the arrow L direction while aiming at a center of the first hole 101*a*, a risk of damage of the gear 103 due to collision between the shaft 102*a* and the gear 103 can be reduced.

In recent years, in the image forming apparatus, a demand for image blur prevention increases. Against such a backdrop, in order to alleviate the image blur due to a rotational speed fluctuation of the gear engaging with the motor, there is a need to position the motor and the gear with high accuracy.

In the constitution of JP-A 2003-255638, in order to position the motor 102 and the gear 103 with high accuracy, although shortening of an arc-omitting portion 101*c* of the first hole 101*a* is effective, the second hole 101*b* decreases with a shortening arc-omitting portion 101*c*. In the case where the second hole 101*b* decreases in such a manner, when the shaft 102*a* of the motor 102 is inserted into the second hole 101*b*, there is a liability that the shaft 102*a* contacts an edge portion of the second hole 101*b* and is damaged. Further, there is a liability that assembling operativity becomes poor by excessive consciousness of the risk of damage of the shaft 102 in the above-described manner.

SUMMARY OF THE INVENTION

The present invention has been accomplished in view of the above-described circumstances. A principal object of the present invention is to provide a driving device capable of not only improving assembling operativity but also suppressing damage of a motor and a gear.

According to an aspect of the present invention, there is provided a driving device comprising: a motor including a shaft portion provided with a gear portion; a side plate provided with a first hole through which the motor engages with the side plate and a second hole connecting with the first hole; a gear configured to engage with the gear portion provided on the shaft portion when the motor is fixed in the first hole, so as to be rotatable through transmission of a driving force from the motor; and a flexible cover member configured to cover the second hole, wherein the cover member contacts the shaft portion of the motor when the shaft portion of the motor is inserted into the second hole.

According to another aspect of the present invention, there is provided a driving device comprising: a motor including a shaft portion; a side plate provided with a motor mounting hole, wherein the motor mounting hole has a contour having a shape such that a first hole and a second hole which are circular holes are superposed with each other; a gear engaging with the shaft portion of the motor in a state of being fixed in the first hole; and a flexible protective member including a cover portion covering at least a part of the second hole, wherein in a state in which the shaft portion of the motor is inserted into the second hole, the cover portion of the protective member is flexed by contact with the shaft portion.

Further features of the present invention will become apparent from the following description of exemplary embodiments with reference to the attached drawings.

Figure 4:
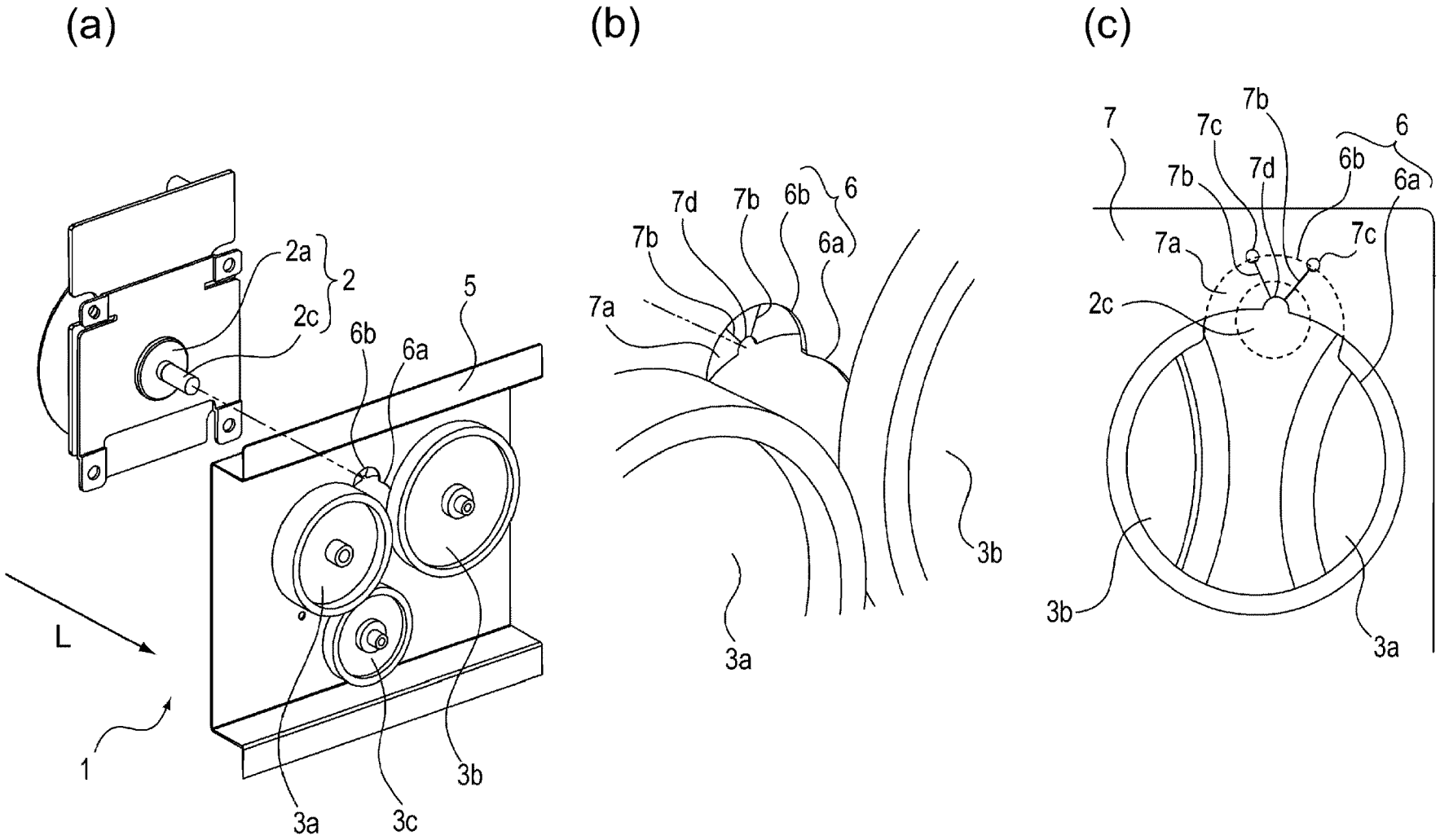

Parts (a) to (c) of FIG. 4 are perspective views of the driving unit before assembling of a motor.

Figure 5:
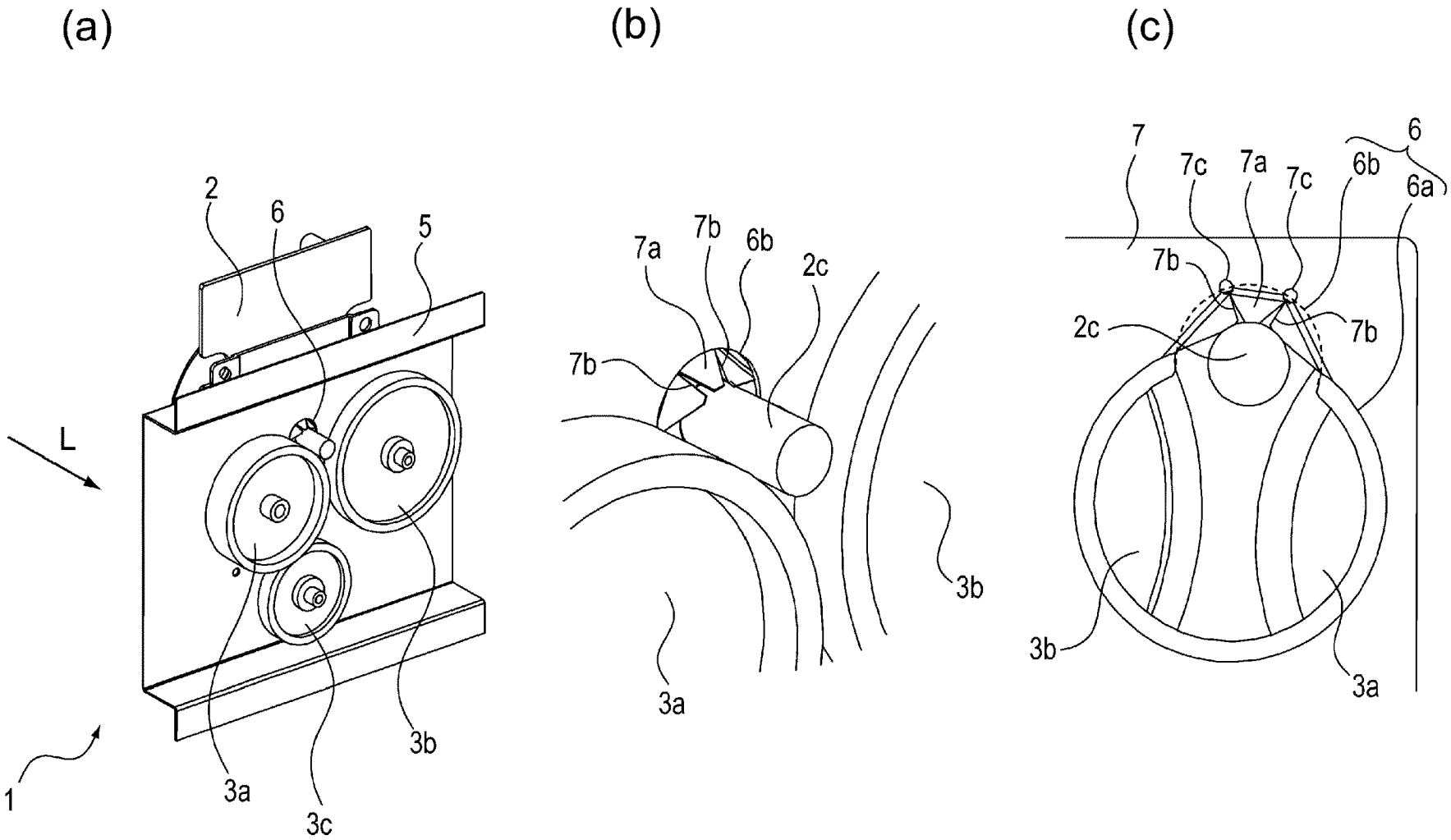

Parts (a) to (c) of FIG. 5 are perspective views of the driving unit in a state in which a shaft of the motor is inserted into a second hole of a first side plate.

Figure 6:
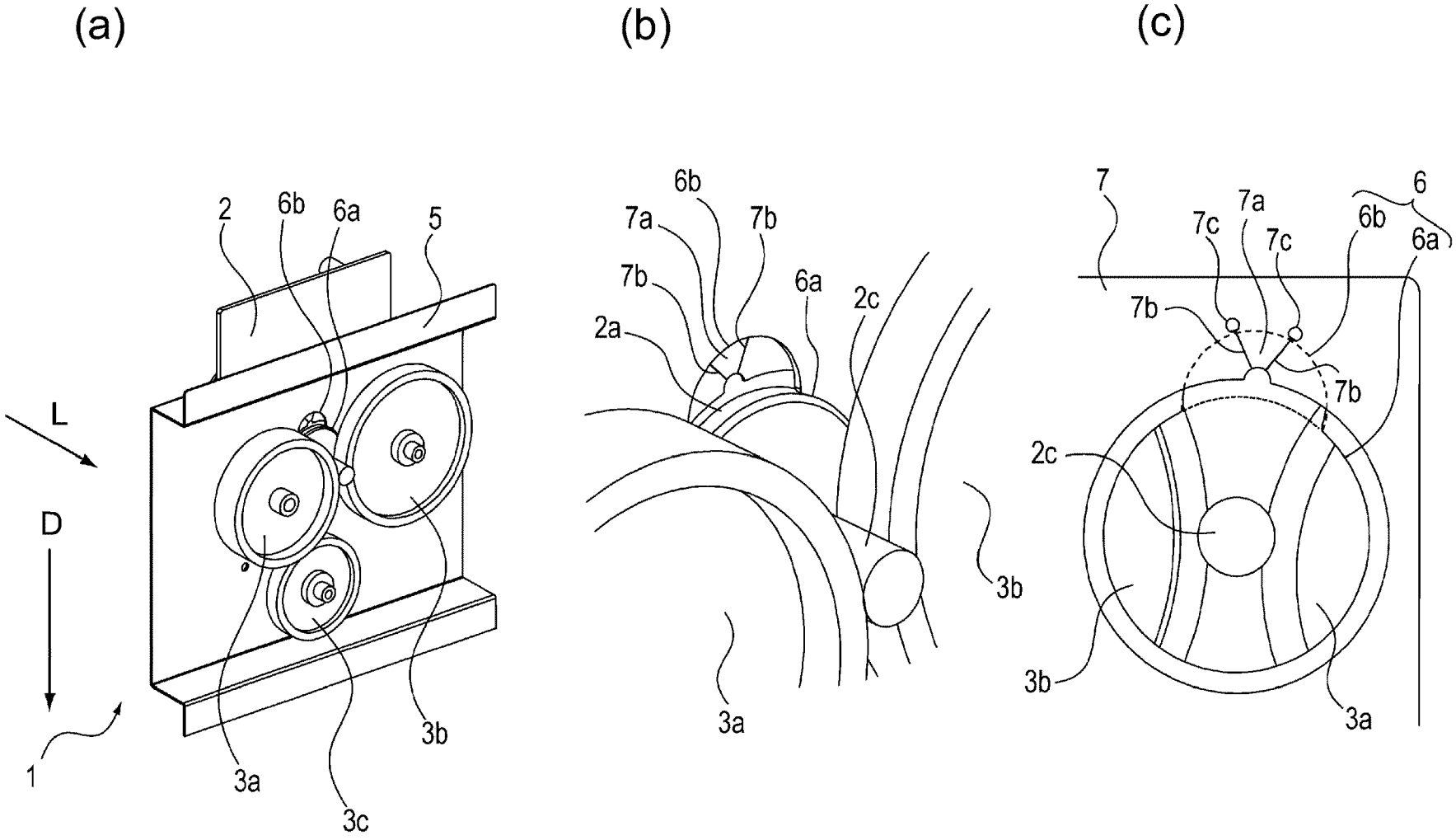

Parts (a) to (c) of FIG. 6 are perspective views of the driving unit after assembling of the motor.

Figure 7:
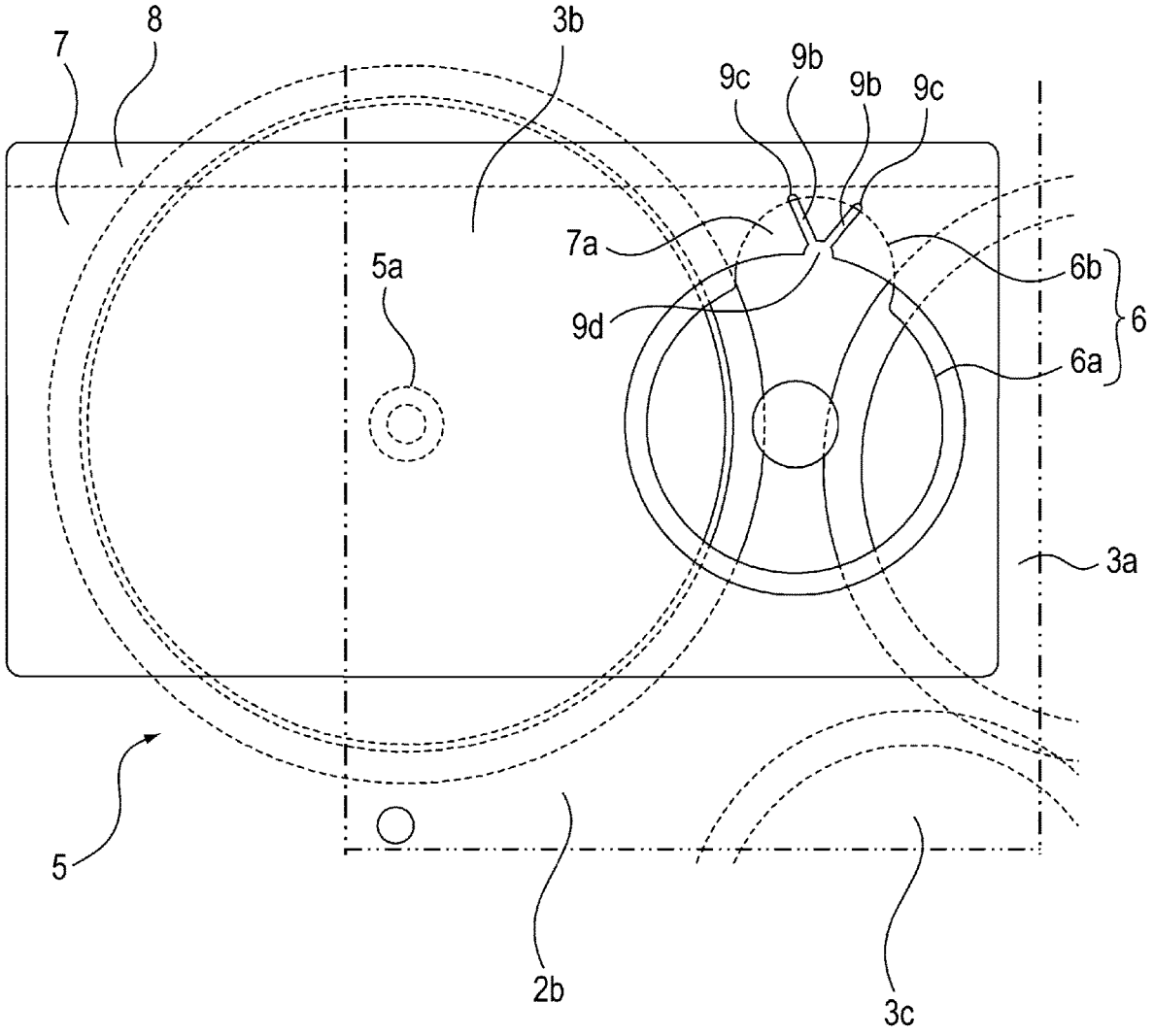

FIG. 7 is an enlarged plan view of a peripheral portion of a protective member of a driving unit having another constitution.

Figure 8:
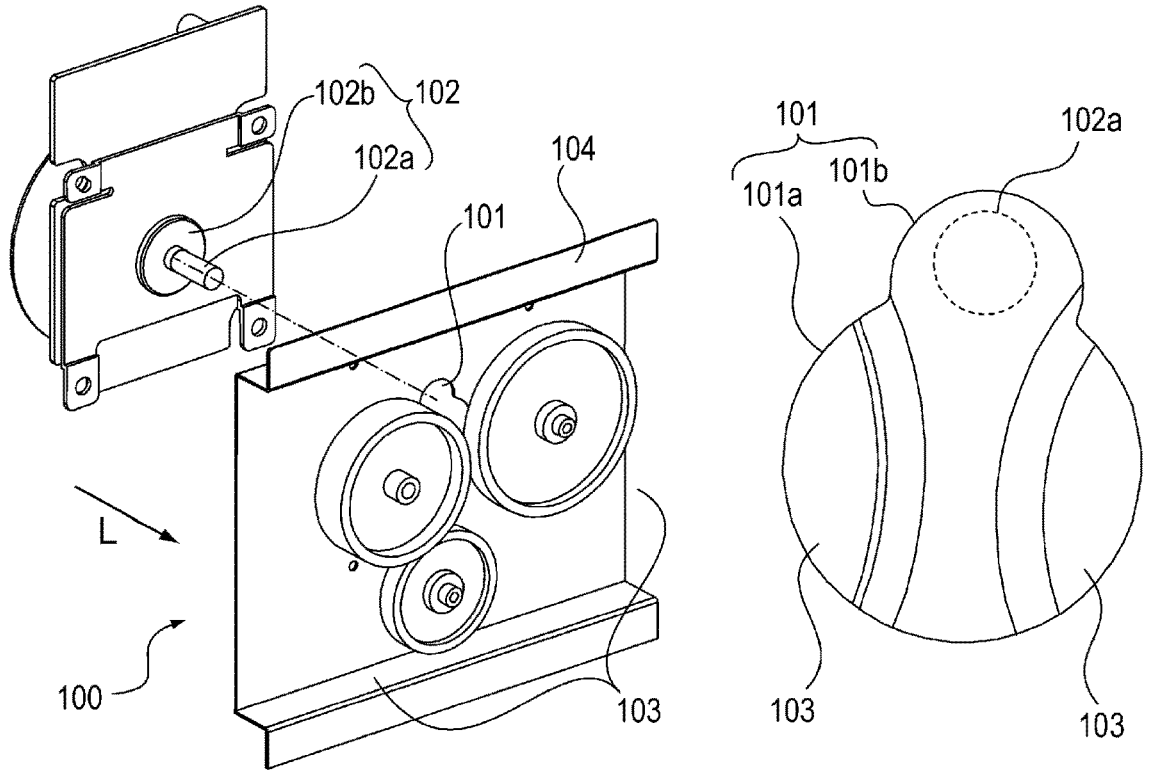
Figure 8:
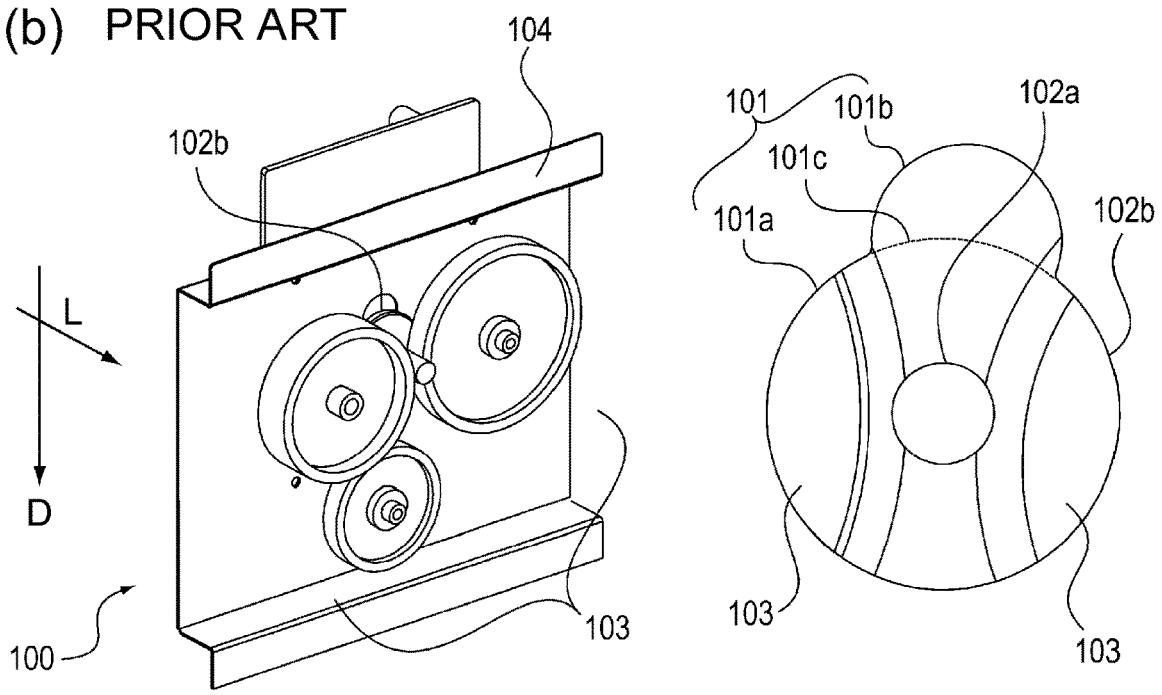

Parts (a) and (b) of FIG. 8 are schematic views showing a structure of a conventional driving device.

DESCRIPTION OF EMBODIMENTS

First Embodiment

<Image Forming Apparatus>

First, a general structure of an image forming apparatus A including a driving device according to First Embodiment of the present invention will be described together with an operation during image formation with reference to the drawings. Incidentally, dimensions, materials, shapes and relative arrangement and the like of constituent elements described below are not intended such that the scope of the present invention is limited to only thereto unless otherwise specified.

Figure 1:
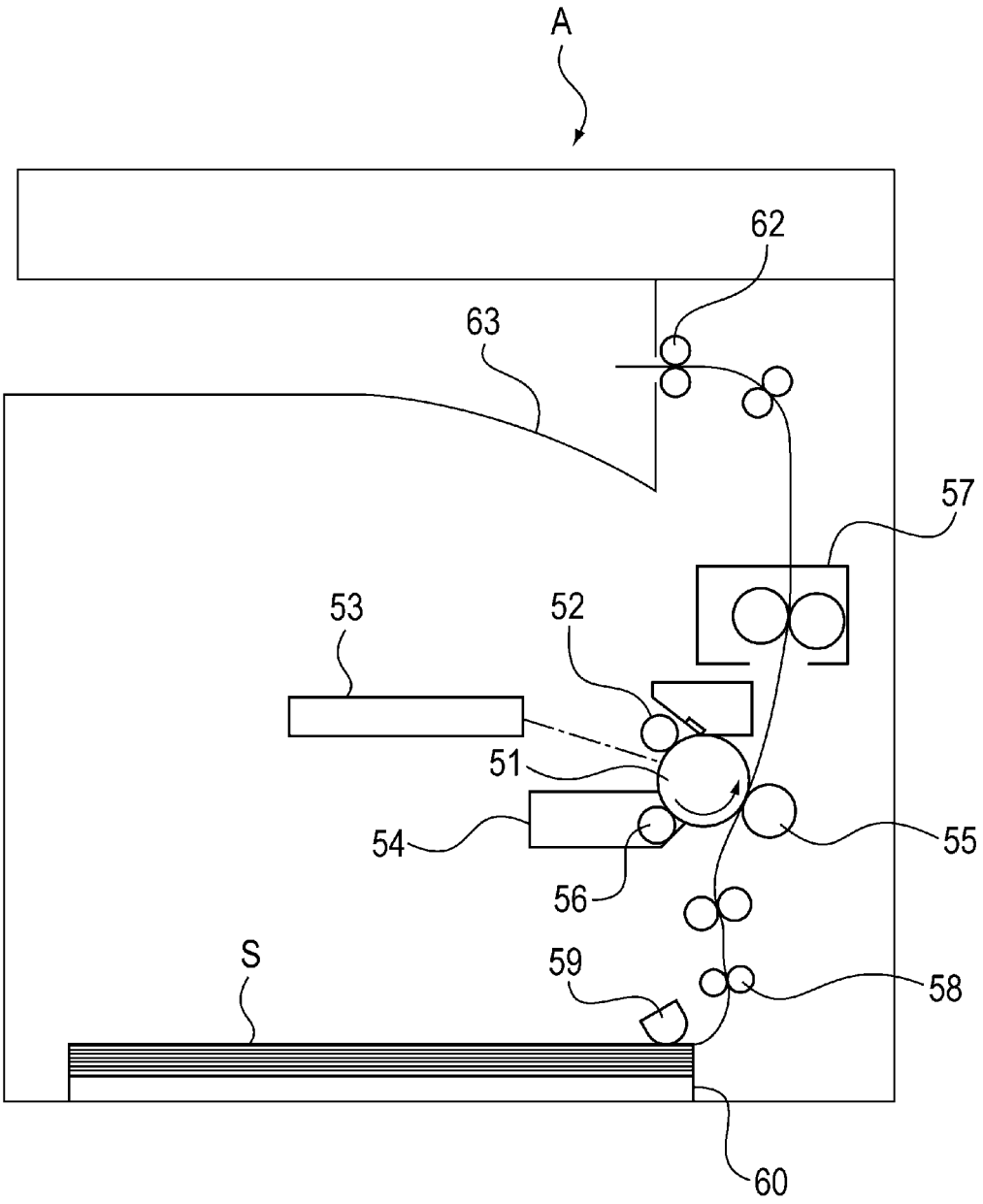
FIG. 1 is a schematic sectional view of an image forming apparatus.

As shown in FIG. 1, the image forming apparatus A includes an image forming portion for transferring a toner image onto a sheet (recording material) S, a sheet feeding portion for feeding the sheet S to the image forming portion, and a fixing portion for fixing the toner image on the sheet S.

The image forming portion includes a photosensitive drum 51, a charging roller 52, a laser scanner unit 53, a developing device 54, a transfer roller 55 and the like.

On the occasion of the image formation, when an unshown controller receives an image forming job signal, the sheet S stacked and accommodated in a sheet stacking portion 60 is sent to the image forming portion by a feeding roller 59 and a conveying roller pair 58.

On the other hand, in the image forming portion, a surface of the photosensitive drum 51 contacting the charging roller 52 is electrically charged by applying a charging bias to the charging roller 52. Thereafter, the laser scanner unit 53 emits laser light from a light source (not shown) provided therein, so that the surface of the photosensitive drum 51 is irradiated with the laser light depending on image information. As a result, a potential of the photosensitive drum 51 partly lowers, so that an electrostatic latent image depending on the image information is formed on the surface of the photosensitive drum 51.

Thereafter, a developing bias is applied to a developing sleeve 56 of the developing device 54, so that toner is deposited by the developing sleeve 56 on the electrostatic latent image formed on the surface of the photosensitive drum 51 and thus the toner image is formed. The toner image formed on the surface of the photosensitive drum 51 is sent to a transfer nip formed by the photosensitive drum 51 and the transfer roller 55.

When the toner image reaches the transfer nip, to the transfer roller 55, a transfer bias of an opposite polarity to a charge polarity of the toner is applied. As a result, the toner image is transferred onto the sheet S conveyed to the transfer nip.

Thereafter, the sheet S on which the toner image is transferred is sent to a fixing device 57, and is heated and pressed by the fixing device 57, so that the toner image is fixed on the sheet S. Thereafter, the sheet S is discharged on a discharge tray 63 by a discharging roller pair 62.

<Driving Device>

Next, a constitution of a driving device for driving respective rollers and respective units will be described by using a driving unit 1 for rotationally driving rollers for feeding (conveying) the sheet S as an example.

Figure 2:
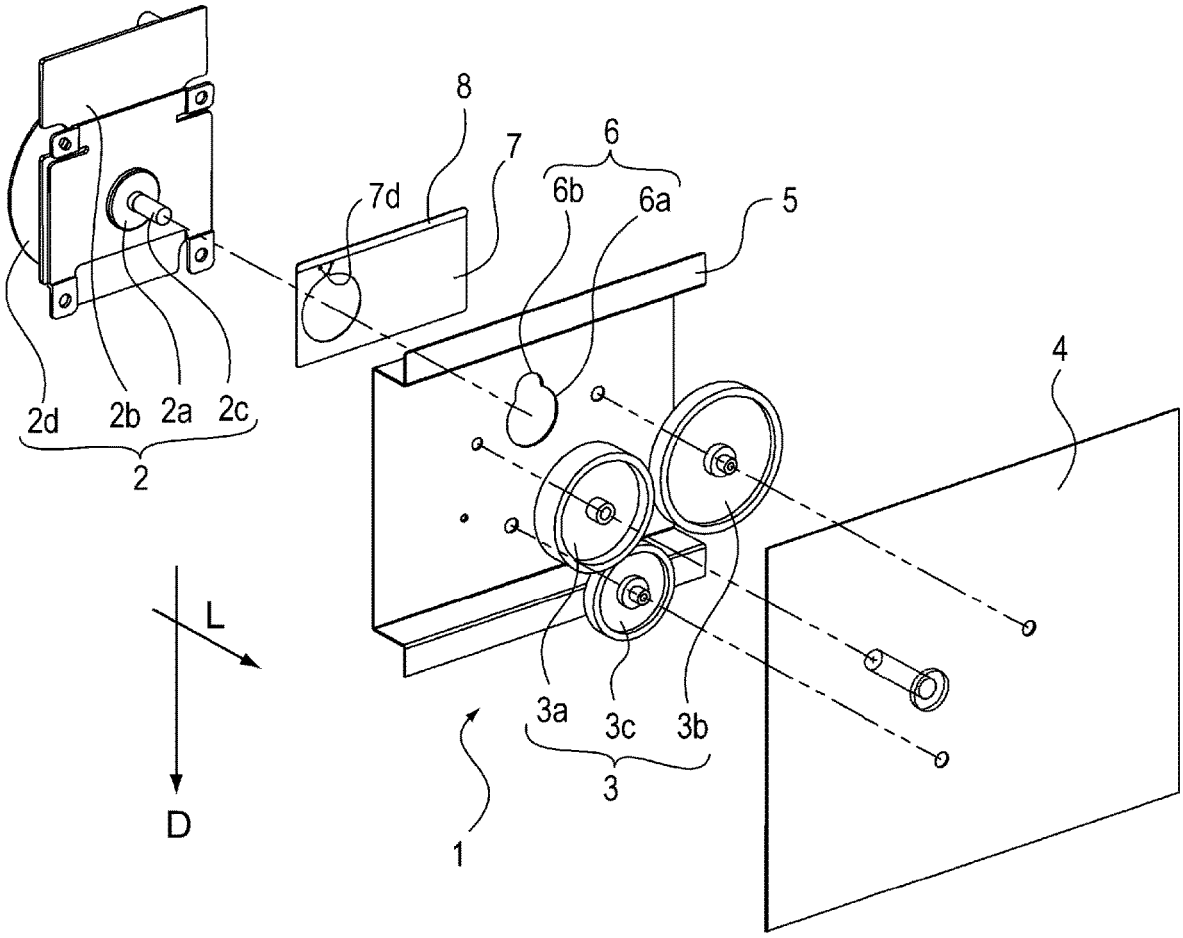
FIG. 2 is an exploded perspective view of a driving unit.

FIG. 2 is an exploded perspective view of the driving unit 1. As shown in FIG. 2, the driving unit 1 includes a motor 2, gears 3 (3*a*, 3*b*, 3*c*) to be rotated by transmitting a driving force thereto from the motor 2, a first side plate 5 to which the motor 2 is to be fixed, a second side plate 4 and a protective member 7. Incidentally, in the driving unit 1, other gears to be engaged with the gears, respectively, are also provided, but will be omitted from illustration for convenience of explanation.

The motor 2 includes a positioning portion 2*a*, a substrate portion 2*b*, a shaft (portion) 2*c* provided with a gear portion, and a casing 2*d*.

The first side plate 5 is provided with a motor mounting hole 6, and the motor mounting hole 6 is constituted by a first hole 6*a* in which the positioning portion 2*a* of the motor 2 is engaged and fixed and by a second hole 6*b* formed in communication with the first hole 6*a*. The first side plate 5 rotatably (shaft-)supports an end portion of rotation shafts of the gears 3. A contour of the motor mounting hole 6 in this embodiment has a shape such that the first hole 6*a* and the second hole 6*b* which are circular holes are superposed with each other. A radius of curvature of the second hole 6*b* is smaller than a radius of curvature of the first hole 6*a*.

The protective member 7 is a sheet-like member provided between the motor 2 and the first side plate 5 and is formed of a flame-retardant material in this embodiment, and is fixed to the first side plate 5 with a double-side tape 8. As the frame-retardant material, for example, polycarbonate having a flame-retardant grade of UL94-VTM0 is used. The material and a fixing method of the protective member 7 are not limited to those in this embodiment.

During drive of the driving unit 1, first, the shaft 2*c* of the motor 2 is rotated by reception of a signal from the unshown controller of the image forming apparatus A. Further, a driving force of the motor 2 is transmitted by the gears 3, so that the feeding roller 59 and the conveying roller pair 58 shown in FIG. 1 are rotated in interrelation with rotation of the gears 3 and thus the sheet S is conveyed.

<Protective Member>

Figure 3:
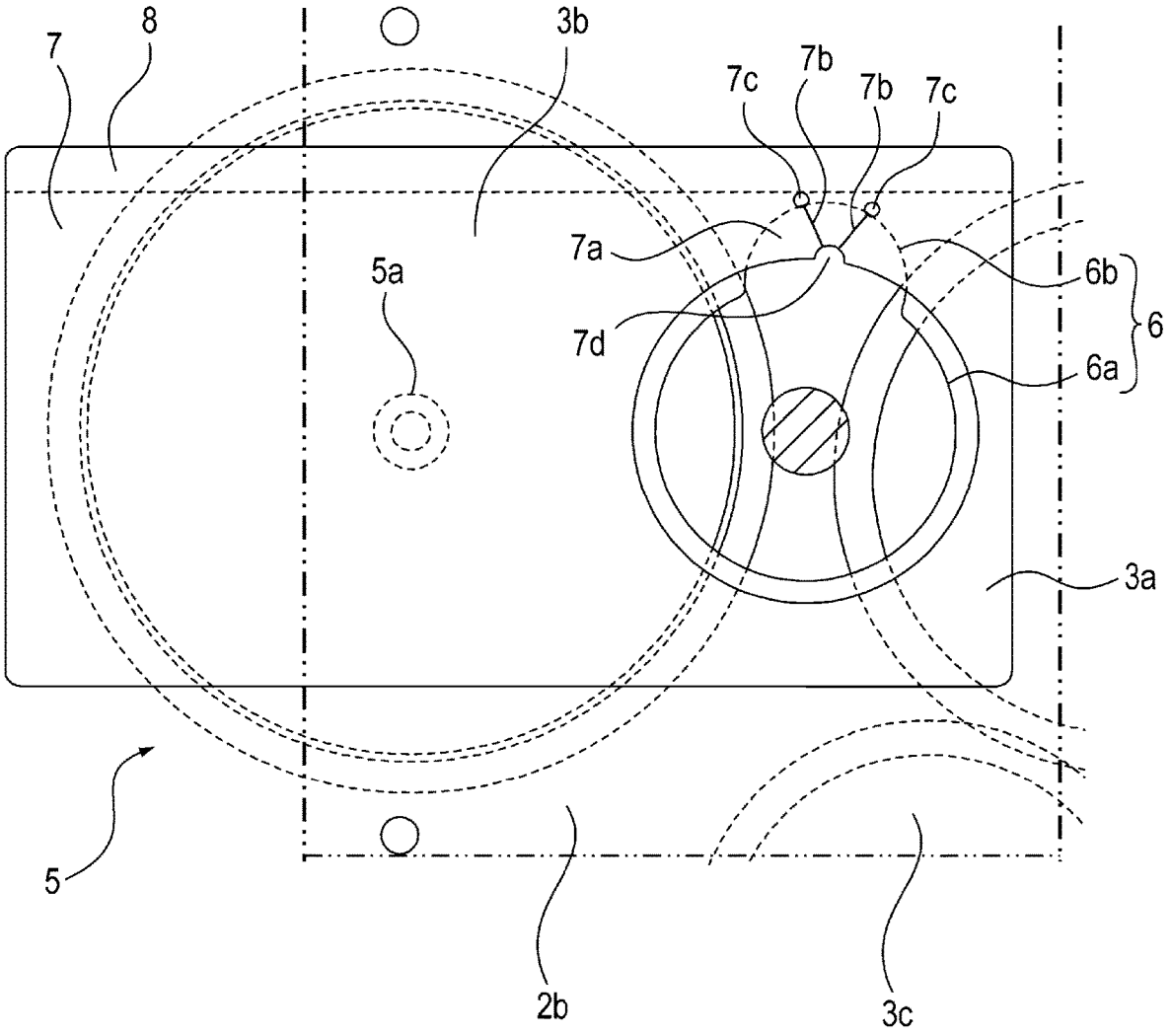
FIG. 3 is an enlarged plan view of a peripheral portion of a protective member of the driving unit.

A structure of the protective member 7 will be described with reference to FIG. 3. FIG. 3 is an enlarged plan view of a peripheral portion of the protective member 7 when the driving unit 1 is seen in an arrow L direction shown in FIG. 2. For convenience of explanation, a part of the motor 2 is not sight in FIG. 3.

As shown in FIG. 3, the protective member 7 includes a cover portion (cover member) 7*a* covering the second hole 6*b* of the first side plate 5. The cover portion 7*a* is provided with two slits 7*b*, thus having flexibility.

Of end portions of each of the two slits 7*b*, at the end portion in a far side from the first hole 6*a*, an end portion hole (hole portion) 7*c* connected with the slit 7*b* is formed. By providing such an end portion hole 7*c*, the cover portion 7*a* is prevented from tearing when the shaft 2*c* of the motor 2 is inserted into the second hole 6*b* as described later.

Further, of the end portions of each of the two slits 7*b*, at the end portion in a near side to the first hole 6*a*, a target hole (hole portion) 7*d* connected with the slit 7*b* is formed. By providing such a target hole 7*d*, an assembling operator easily recognizes a target position when the shaft 2*c* of the motor 2 is inserted into the second hole 6*b* as described later.

<Assembling Procedure>

Next, not only an assembling procedure when the motor 2 is assembled with the first side plate 5 but also a principal function of the protective member 7 will be described.

Parts (a) to (c) of FIG. 4 are perspective views of the driving unit 1 before the assembling of the motor 2. Here, in FIG. 4, part (a) is the perspective view of the driving unit 1, part (b) is an enlarged perspective view of a peripheral portion of the motor mounting hole 6, and part (c) is an enlarged plan view of the peripheral portion of the motor mounting hole 6 as seen in the arrow L direction. Incidentally, for convenience of explanation, in FIG. 4, a part of the motor 2 and the second side plate 4 are not in sight.

As shown in FIG. 4, when the motor 2 is assembled with the first side plate 5, first, the shaft 2*c* of the motor 2 is inserted into the second hole 6*b* in the arrow L direction. At this time, the shaft 2*c* is inserted while aiming at the target hole 7*d*, of the protective member 7, as a target position.

Parts (a) to (c) of FIG. 5 are perspective views of the driving unit 1 in a state in which the shaft 2*c* of the motor 2 is inserted into the second hole 6*b* of the first side plate 5. Here, in FIG. 5, part (a) is the perspective view of the driving unit 1, part (b) is an enlarged perspective view of a peripheral portion of the motor mounting hole 6, and part (c) is an enlarged plan view of the peripheral portion of the motor mounting hole 6 as seen in the arrow L direction. Incidentally, for convenience of explanation, in FIG. 5, a part of the motor 2 and the second side plate 4 are not in sight.

As shown in FIG. 5, when the shaft 2*c* of the motor 2 is inserted into the second hole 6*b*, the shaft 2*c* and the cover portion 7*a* of the protective member 7 contact each other. The cover portion 7*a* has the flexibility as described above, and therefore, the shaft 2*c* is inserted into the second hole 2*b* while the cover portion 7*a* flexes. As shown in part (b) of FIG. 5, in a state in which the shaft (portion) 2*c* of the motor 2 is inserted into the second hole 6*b*, the cover portion 7*a* of the protective member 7 flexes by contact thereof with the shaft 2*c*.

Parts (a) to (c) of FIG. 6 are perspective views of the driving unit 1 after the assembling of the motor 2. Here, in FIG. 6, part (a) is the perspective view of the driving unit 1, part (b) is an enlarged perspective view of a peripheral portion of the motor mounting hole 6, and part (c) is an enlarged plan view of the peripheral portion of the motor mounting hole 6 as seen in the arrow L direction. Incidentally, for convenience of explanation, in FIG. 6, a part of the motor 2 and the second side plate 4 are not in sight.

As shown in FIG. 6, after the shaft 2*c* of the motor 2 is inserted into the second hole 6*b*, the motor 2 is moved in an arrow D direction. As a result, the motor 2 and the gears 3*a* and 3*b* engage with each other, so that the driving force can be transmitted. Further, the positioning portion 2*a* of the motor 2 and the first hole 6*a* of the motor mounting hole 6 are engaged with each other, so that the motor 2 is fixed to the first side plate 5.

Thus, the shaft 2*c* is inserted into the second hole 6*b*, and thereafter, the motor 2 and the gears 3 are engaged with each other, so that compared with a constitution in which the shaft 2*c* is directly inserted into the first hole 6*a* while aiming at the center of the first hole 6*a*, the risk of damage of the gears 3 due to collision between the shaft 2*c* and the gears 3 can be reduced.

Further, when the shaft 2*c* of the motor 2 is inserted into the second hole 6*b*, the shaft 2*c* is inserted while contacting the cover portion 7*a* of the protective member 7, so that it is possible to lower a risk of damage of the shaft 2*c* due to direct contact of the shaft 2*c* with an edge portion of the second hole 2*c*. Further, for the assembling operator, there is no need to be excessively conscious of the risk of damage of the shaft 102*a*, and therefore the assembling operativity can be improved by such a constitution.

Accordingly, according to the above-described constitution, it is possible to not only improve the assembling operativity of the driving unit 1 but also suppress the damage of the motor 2 and the gears 3.

In this embodiment, although the protective member 7 and the first side plate 5 are constituted as separate members, the present invention is not limited thereto, but the protective member 7 and the first side plate 5 may also be constituted as an integral member (unit). That is, even in the case where the protective member 7 and the first side plate 5 are formed as the integral member, when the cover portion 7*a* which covers the second hole 6*b* of the first side plate 5 and which contacts the shaft 2*c* of the motor 2 during the insertion of the shaft 2*c* into the second hole 6*b*, a principal function of the protective member 7 is achieved, so that effects similar to those described above can be obtained.

In this embodiment, although the constitution in which the cover portion 7*a* is provided with the two slits 7*b* is described, the present invention is not limited thereto. That is, the number of the slits 7*b* may also be one or three or more.

Further, a constitution in which the cover portion 7*a* is not provided with the slits 7*b* but is provided with grooves 9*b* each having a width as shown in FIG. 7 and thus the cover portion 7*a* has flexibility may also be employed. In the case where the grooves 9*b* each having the width are formed as described above, at an end portion of each grooves 9*b* in a far side from the first hole 6*a*, the groove 9*b* is shaped to have a curved surface 9*c*, so that the cover portion 7*a* is prevented from tearing when the shaft 2*c* of the motor 2 is inserted into the second hole 6*b*. Further, at an end portion of each groove 9*b* in a near side to the first hole 6*a*, a target hole (hole portion) 9*d* is formed, so that the assembling operator easily recognizes a target position when the shaft 2*c* of the motor 2 is inserted into the second hole 6*b*.

By employing the constitution in which the grooves 9*b* as described above, in a manufacturing step of the protective member 7, an inner peripheral shape including the grooves 9*b*, the curved surfaces 9*c* and the target hole 9*d* can be formed in the same die-cutting (punching) step, so that cost reduction by reducing the number of steps can be realized. Incidentally, the number of the grooves 9*b* is not limited to two, but may also be one or three or more.

Further, the cover portion 7*a* is not necessarily provided with the slits 7*b* or the grooves 9*b*, and when the constitution in which the cover portion 7*a* has the flexibility is employed, the above-described effects can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-226695 filed on Nov. 22, 2016, which is hereby incorporated by reference herein in its entirety.

What is claimed is:

1. A driving device comprising:

a motor including a shaft portion provided with a gear portion;

a side plate provided with a first hole including a first portion through which said motor engages with said side plate and a second portion connecting with the first position;

a gear configured to engage with said gear portion provided on said shaft portion when said motor is fixed in the first portion, so as to be rotatable through transmission of a driving force from said motor; and a flexible cover member configured to cover the second portion, wherein said cover member contacts the shaft portion of said motor when the shaft portion of said motor is inserted into the second portion, wherein said cover member includes a slit and a second hole which is connected with an end portion of said slit in a far side from the first portion.

2. A driving device according to claim 1, wherein said cover member has a third hole connected with an end portion of said slit at in a near side to the first portion.

3. A driving device according to claim 1, wherein said cover member is provided with a groove having a width.

4. A driving device according to claim 3, wherein the end portion of the groove in a far side from the first portion is a curved surface.

5. A driving device according to claim 3, wherein the end portion of the groove in a near side to the first portion is provided with a second hole connected with the groove.

6. A driving device according to claim 1, wherein said cover member is a sheet like member formed of a flame retardant material.

7. A driving device according to claim 1, wherein said cover member is formed as a member separate from said side plate.

8. A image forming apparatus comprising:

an image forming portion configured to form an image on a recording material; and a driving device according to claim 1.

9. An image forming apparatus according to claim 8, wherein said driving device rotationally drives a roller for feeding a recording material.

* * * * *